United States Patent [19]

Porter et al.

[11] 4,324,559

[45] Apr. 13, 1982

[54] METHOD FOR THE REMOVAL OF SULFUR FROM CARBONACEOUS MATERIAL

[76] Inventors: Clifford R. Porter, 11457 W. 69th Pl., Arvada, Colo. 80004; Herbert D. Kaesz, 2631 Westridge Rd., Los Angeles, Calif. 90049

[21] Appl. No.: 189,087

[22] Filed: Sep. 22, 1980

[51] Int. Cl.[3] ..... C10L 9/02
[52] U.S. Cl. ..... 44/1 SR; 201/17
[58] Field of Search ..... 44/1 SR; 201/17

[56] References Cited

U.S. PATENT DOCUMENTS

| | | | |
|---|---|---|---|
| 3,996,130 | 12/1976 | Nametkin et al. | 208/243 |
| 4,119,410 | 10/1978 | Kindig et al. | 44/1 SR |
| 4,146,367 | 3/1979 | Hsu | 44/1 SR |
| 4,233,034 | 11/1980 | Miller et al. | 44/1 SR |

*Primary Examiner*—Carl F. Dees
*Attorney, Agent, or Firm*—Sheridan, Ross & McIntosh

[57] ABSTRACT

Sulfur is removed from carbonaceous material by contacting the material with a metal carbonyl or a low valent complex of the transition metals and water under alkaline conditions to form a reaction mixture, and then heating the mixture for a sufficient period of time to obtain sulfur removal from the carbonaceous material.

28 Claims, No Drawings

METHOD FOR THE REMOVAL OF SULFUR FROM CARBONACEOUS MATERIAL

BACKGROUND AND SUMMARY OF THE INVENTION

The present invention relates to the desulfurization of carbonaceous material, and more particularly to a method for the removal of organic and/or inorganic sulfur from carbonaceous material by treatment of the material with a metal carbonyl or a low valent complex of the transition metals under alkaline conditions in the presence of water.

The present world-wide emphasis on the energy crisis has resulted in increased attention by both governmental and private organizations to the need for readily available and environmentally acceptable energy sources. One of the major problems in the utilization of some carbonaceous materials, such as some coals, crude petroleum oils, primary refinery products, and the like, occurs when the carbonaceous material has a relatively high sulfur content. It has been found that combustion of high sulfur content carbonaceous materials can result in the formation of compounds, like sulfur oxides, which have been found to be environmentally undesirable when present in large quantities.

For example, the United States has vast resources of coal for development as a potential energy source. Depending on their origin, coals contain varying amounts of sulfur, which may be present, for example, as elemental sulfur, as iron disulfide or pyritic sulfur, as sulfate sulfur, or as organic bound sulfur. The presence of sulfur in coal is a tremendous disadvantage to the use of the coal as an energy source, particularly in view of the emphasis on pollution control as illustrated by federal emission control standards for sulfur dioxide. Illustrating the enormity of the sulfur dioxide emission problem is the fact that large transportation expenses are incurred by coal users in transporting Western and European coal of relatively low sulfur content long distances to supplant available high sulfur-containing coals in order to make compliance with sulfur dioxide emission standards possible when using coal as an energy source. There has been a longfelt need for an economically and commercially feasible means for absorbing the large amounts of sulfur dioxide emitted by the combustion of coal. Currently, U.S. utilities in burning about 395 million tons of coal a year generate about 21 million tons of sulfur dioxide in the process.

In other carbonaceous materials, such as crude petroleum and primary refinery products, sulfur and some sulfur-containing compounds can be highly corrosive to engine components when present in fuels, can form combustion products which can be highly corrosive and/or can cause sulfur poisoning in catalytic processes, particularly where cobalt, nickel, and related catalysts are employed.

Various methods for removing impurities such as sulfur from raw coal and other carbonaceous materials have been extensively tested over the years. Among these are methods which employ the difference in specific gravity between coal particles and non-coal particles, or differences in their surface, electrostatic, chemical, or magnetic properties. For various reasons, difficulties are encountered in making an efficient gravity separation of impurities from coal which has been ground sufficiently fine to substantially liberate non-coal particles from coal particles. In water systems this difficulty is typically related to the slow settling rate of fine particles, and in air systems to the large difference in specific gravity between air and particles. However, some success in the removal of pyritic sulfur, ash-forming minerals, and various sulfates has been obtained by processes which enhance the magnetic susceptibility of the pyrite, ash-forming minerals, or sulfates, thereby permitting removal of these impurities by magnetic separation means. For example, U.S. Pat. Nos. 3,938,966, 4,098,584, 4,119,410, 4,120,665 and 4,175,924 relate to such processes. In addition, it has been suggested in U.S. Pat. No. 4,119,410 that heat pretreatment may be used to remove elemental sulfur from coal. While the foregoing processes have been effective in the removal of pyritic sulfur and other impurities from coal by enhancing magnetic susceptibility, there is no suggestion in these patents that such processes have any effect on the organic bound sulfur of carbonaceous material or on the removal of inorganic sulfur by other than magnetic means.

Organic sulfur in carbonaceous material is typically bound in the material in the form of sulfides, disulfides, mercaptans, thiophenes, derivatives thereof and the like. It has been suggested in U.S. Pat. No. 4,146,367 of Hsu that a portion of the organic bound sulfur may be removed from coal by slurrying the coal in an aromatic hydrocarbon solvent containing iron pentacarbonyl and then heating the slurry to a temperature of above 40° C. but less than 150° C. for from 1 to 10 hours. Due to the nature of sulfur containing coal, reaction under the conditions disclosed by Hsu is characteristically conducted in acidic media. The reaction of iron carbonyl with organic bound sulfur under the foregoing conditions is disclosed by Hsu to involve the desulfurization of thiophene compounds resulting in the formation of carbonyl sulfide and compounds containing iron and sulfur. In addition to the foregoing, U.S. Pat. No. 3,996,130 of Nametkin et al. discloses reducing the sulfur, nitrogen and oxygen content of crude petroleum and primary refinery products by treatment with $\pi$-complexes of transition metals such as iron carbonyl, salts of platinum metals such as $Na_4PtCl_4$ and $Na_2PtCl_4$, or $\pi$-allylic complexes of platinum group metals at a temperature of from 80° to 120° C., followed by treatment with a chelating agent to react with unconverted organometallic compounds, and finally by separation of the target compounds from the reaction mixture, such as by distillation.

It has now been determined that removal of sulfur from carbonaceous materials, such as coal, crude petroleum, primary refinery products and the like, can be obtained by contacting the carbonaceous material with an agent selected from the group consisting of metal carbonyls, other low valent complexes of the transition metals, and mixtures thereof, and water under alkaline conditions, and heating the mixture for a sufficient period of time to obtain sulfur removal from the carbonaceous materials. When the agent is iron carbonyl, for example, reaction of the sulfur with iron carbonyl at alkaline pH levels appears to involve formation of iron tetracarbonyl hydride anion, $HFe(CO)_4^-$, and/or iron tetracarbonyl dihydride, $H_2Fe(CO)_4$, which appear to be more reactive with the sulfur of the carbonaceous material than is iron pentacarbonyl, $Fe(CO)_5$, of the processes disclosed in the Hsu and Nametkin et al. patents.

DESCRIPTION OF ILLUSTRATIVE EMBODIMENTS

As used herein, the term "carbonaceous material" includes organic materials containing sulfur or sulfur-containing compounds which are susceptible to the treatment method. Examples of carbonaceous materials which may be used in connection with the practice of the invention include coal, coal derived liquids such as those obtained in a coal liquifaction process, crude petroleum oil, primary refinery products and like materials. Suitable coals include anthracite, bituminous, subbituminous and lignite coals. Suitable primary refinery products include refined fractions of crude oil, partially refined fractions of crude oil, side cuts from crude columns, crude column overheads, gas oils, kerosenes, straight run gasoline, and the like. Other suitable carbonaceous materials include synthesized hydrocarbons, shale oil, tar sand oil and the like.

The term "total sulfur" means all sulfur in the carbonaceous material, including organic sulfur, inorganic sulfur and elemental sulfur. The term "organic bound sulfur" or "organic sulfur" means sulfur chemically bound in, or complexed with, organic compounds in the carbonaceous material. Organic bound sulfur is typically found in carbonaceous materials in the form of sulfides, disulfides, mercaptans, thiophene, and derivatives thereof, although it may be present in other forms. The term "inorganic sulfur" means sulfur chemically bound in, or complexed with, inorganic compounds in or mixed with the carbonaceous material. Inorganic sulfur is typically found in carbonaceous materials in the form of pyrite, marcasite and sulfate sulfur, although it may be present in other forms. The present invention is particularly useful in connection with the treatment of carbonaceous materials having a total sulfur content greater than about 0.8% by weight and/or an organic or inorganic sulfur content greater than about 0.4% by weight, although it may be employed with carbonaceous materials having less organic and/or inorganic sulfur.

As used herein, the terms "solvent" and "solvent medium" mean a penetration facilitating or solubilizing medium which may facilitate penetration of the sulfur content reducing agent into the carbonaceous material, may solubilize at least a portion of the carbonaceous material and/or sulfur content reducing agent, and/or may otherwise facilitate desulfurization of the carbonaceous material during practice of the present invention.

To facilitate the removal of sulfur from solid carbonaceous materials, such as coal, it is preferable to comminute the coal prior to treatment according to the process of the present invention. The coal is preferably comminuted to an average top particle size of less than about 50 mesh, more preferably to an average top particle size of less than about 100 mesh and most preferably to an average top particle size of less than about 200 mesh.

In accordance with the present invention, sulfur-containing carbonaceous material is contacted with a solution comprising a sulfur content reducing agent and water to form a reaction mixture or slurry. The pH of the reaction mixture or slurry is maintained within the range of about 7.5 to about 10.7, and the reaction mixture or slurry is heated for a sufficient period of time to result in an organic and/or inorganic sulfur reduction in the carbonaceous material. The reaction mixture or slurry preferably further comprises a solvent medium, as is hereinafter further described.

Suitable sulfur content reducing agents include metal carbonyls, other low valent complexes of the transition metals, derivatives thereof and mixtures thereof. Examples of suitable metal carbonyls include the transition metal carbonyls of Groups V B, VI B, VII B and VIII of the periodic system. Specific examples include the carbonyls of vanadium, chromium, manganese, iron, cobalt, nickel, molybdenum, ruthenium, palladium, and tungsten. For purposes of safety and economy, the presently preferred metal carbonyls are iron pentacarbonyl, diiron nonacarbonyl and triiron dodecacarbonyl. Other suitable metal complexes include those containing metal atoms in a chemical form close to that of the metallic state. Specific examples of such low valent complexes include the metallocenes, such as ferrocene, although other low valent metal complexes are useful for this purpose. Suitable derivatives include hydrides of the metal carbonyls and metallocenes, and other chemically active derivatives of these compounds. Mixtures of metal carbonyls and/or their derivatives, mixtures of low valent metal complexes and/or their derivatives and mixtures of one or more metal carbonyls and one or more other low valent metal complexes and/or their derivatives are also useful as sulfur content reducing agents. Methylcyclopentadienyl manganese tricarbonyl is one illustrative example of one mixture useful in the practice of the present invention.

Although the precise reaction mechanism is not completely understood at this time, it is presently believed that under moderately basic reaction conditions, iron pentacarbonyl, for example, is hydrolyzed to iron tetracarbonyl hydride anion and/or iron tetracarbonyl dihydride as follows:

$$Fe(CO)_5 + OH^- \rightleftharpoons HFe(CO)_4^- + CO_2 \quad (1)$$

$$HFe(CO)_4^- + H_2O \rightleftharpoons H_2Fe(CO)_4 + OH^- \quad (2)$$

According to the foregoing reaction scheme, at pH levels less than about 7.5, there may be insufficient hydroxide ion present in the reaction mixture to favor production of iron tetracarbonyl hydride anion according to the reaction to equation (1), above. Similarly, at substantially higher pH levels, for example above about pH 10.7, an excess of hydroxide ion appears to suppress the reaction of iron tetracarbonyl hydride anion with water to form iron tetracarbonyl dihydride according to equation (2), above.

In order to maintain the reaction mixture or slurry within the desired pH range, it may be necessary to add a suitable base to the aqueous solution. Suitable bases for this purpose include any base which would not have a substantial deleterious effect on the carbonaceous material or the desired reaction conditions. Presently preferred bases include the hydroxides, carbonates and bicarbonates of the alkali metals and the alkaline-earth metals. Specific examples of suitable bases include NaOH, KOH, $Mg(OH)_2$, $Ca(OH)_2$, $Na_2CO_3$, $K_2CO_3$, $NaHCO_3$, $KHCO_3$, $CaCO_3$, mixtures thereof, and the like, although other bases may be employed for this purpose. In acidic carbonaceous materials, the pH of the aqueous solution will typically decrease after contact with the carbonaceous material. Therefore, the pH of the reaction mixture or slurry may be maintained in the desired range by carefully controlling the addition of base to the reaction mixture, by incorporating suitable pH buffers in the reaction mixture, or by other suitable means.

Although not essential to the treatment method of the invention, it is a presently preferred practice to additionally incorporate a solvent or solvent medium into the reaction mixture or slurry, which may facilitate penetration of the sulfur content reducing agent into the carbonaceous material, may solubilize at least a portion of the carbonaceous material and/or sulfur content reducing agent, and/or may otherwise facilitate desulfurization of the carbonaceous material during practice of the present invention. When used, suitable solvents preferably exhibit substantial sulfur content reducing agent solubility and optimally exhibit substantial water miscibility. Particularly useful solvents have a boiling point in the range of about 30° C. to about 160° C., more preferably about 40° C. to about 140° C., and most preferably about 55° C. to about 120° C. Examples of suitable solvents include alkyl alcohols having from one to about six carbon atoms, aromatic hydrocarbons, mixtures thereof and their derivatives. Presently particularly preferred solvents include methanol and ethoxyethanol, although other suitable facilitating agents may be employed. The solvent is preferably incorporated into the reaction mixture in a sufficient amount to solubilize at least a portion of the carbonaceous material and/or the sulfur content reducing agent. Additional amounts of solvent may be employed to facilitate sulfur content reducing agent penetration into solid carbonaceous materials. Preferably the solvent may be incorporated in at least about equal volume with the water in the aqueous solution, more preferably at least about 2 volumes of solvent are incorporated per volume of water, and most preferably at least about 2.5 volumes of solvent are incorporated per volume of water. A sufficient amount of water must be present in the aqueous solution to permit the reaction of equation (2), above, to proceed.

The amount of sulfur content reducing agent required in the reaction mixture is dependent upon the sulfur content of the carbonaceous material and the amount of carbonaceous material to be treated. Generally, it is preferable to employ an excess stoichiometric amount of the sulfur content reducing agent based upon the sulfur content of the carbonaceous material.

The reaction mixture is heated to an effective elevated temperature level for a sufficient period of time to permit a substantial sulfur reduction in the carbonaceous material. For most purposes, effective temperature levels are from about 30° C. to a temperature below the decomposition temperature of the sulfur content reducing agent under the reaction conditions employed, more preferably from about 40° C. to about 140° C., and most preferably from about 55° C. to about 120° C. It is frequently convenient to heat the reaction mixture to the reflux temperature of the solvent employed. The reaction mixture is maintained at the elevated temperature for a sufficient period of time to obtain organic and/or inorganic sulfur removal from the carbonaceous material. Sufficient times are dependent upon the nature of the carbonaceous material, the form or forms of organic and inorganic sulfur, the reaction conditions employed, and the like. However, for most purposes, sufficient times are at least about 30 minutes, more preferably from about 1 to about 20 hours and most preferably from about 2 to about 15 hours.

After completion of the reaction, the carbonaceous material may be removed from the reaction mixture by suitable means, such as by filtration, centrifugation, distillation, magnetic separation, and the like, and then washed, such as with the solvent, prior to subsequent utilization of the material. Preferably, the separated carbonaceous material is washed with a sufficient amount of solvent to remove any remaining sulfur content reducing agent and/or to substantially reduce the sulfate sulfur content of the separated carbonaceous material. In a particularly preferred embodiment, any remaining sulfur content reducing agent and/or solvent separated from the carbonaceous material are recycled for reuse in the treatment of additional carbonaceous material.

It has been determined that treatment of carbonaceous materials according to the hereinabove described principles results in the conversion of at least a portion of the organic, pyritic and/or marcasitic sulfur into sulfate sulfur. It is therefore further contemplated that the treatment method disclosed herein may be used in connection with other processes for the removal of inorganic sulfur from carbonaceous materials, including gravity separation, mechanically assisted gravity separation, magnetic separation, other chemical separation, etc.

The foregoing may be further understood in connection with the following illustrative examples.

EXAMPLE 1

Coal obtained from the No. 6 Seam, Ohio, is preprocessed in a conventional gravity separation, screening and drying process, and is then pulverized to a top particle size of 200 mesh. A reaction slurry is formed by suspending 100 g. of the pulverized coal in 400 ml of anhydrous methanol. The reaction mixture is placed in a reaction vessel and is stirred with a motor driven paddle stirrer. Nitrogen gas is continuously purged through the reaction mixture. After stirring and nitrogen gas purge have been initiated, 61.1 g. of iron carbonyl is added to the reaction mixture. The mixture is then heated to a temperature of about 65° C. and refluxed for a period of twenty four hours. The mixture is then cooled and filtered, and the treated coal is dried at a temperature of 100° C. A sulfur analysis of the treated coal, as compared with the raw coal is shown in Table I:

TABLE I

| | Sulfur Content (weight %) | |
|---|---|---|
| | Raw Coal | Treated Coal |
| Pyritic Sulfur | 0.73 | 0.77 |
| Sulfate Sulfur | 0.53 | 0.41 |
| Organic Sulfur | 1.03 | 0.45 |
| Total Sulfur | 2.29 | 1.63 |

EXAMPLE II

The procedure of Example I is repeated using toluene as the solvent and by heating the reaction mixture to the reflux temperature of the toluene. Results similar to Example I are obtained.

EXAMPLE III

An aqueous solution is prepared by adding 84.0 g. of KOH to 200 ml of water. The aqueous solution is then mixed with a suspension of 100 g. of the coal of Example I in 600 ml of anhydrous methanol to form a reaction mixture. Continuous stirring is initiated as in Example I, although no nitrogen gas purge is maintained. After stirring is initiated, 61.1 g. of iron pentacarbonyl is added to the reaction mixture, and the mixture is heated to a temperature of about 65° C. and refluxed for a period of three days. The mixture is then cooled and filtered, and the treated coal is washed with anhydrous methanol. The washed coal is then dried at a temperature of 100° C. A sulfur analysis of the treated coal, as compared with the raw coal, is shown in Table II:

TABLE II

| | Sulfur Content (Dry Basis-weight %) | |
|---|---|---|
| | Raw Coal | Treated Coal |
| Pyritic Sulfur | 0.73 | 0.52 |
| Sulfate Sulfur | 0.53 | 0.91 |
| Organic Sulfur | 1.03 | 0.13 |
| Total Sulfur | 2.29 | 1.56 |

EXAMPLE IV

An aqueous solution is prepared by adding 84.0 g of KOH to 200 ml of water. The aqueous solution is then mixed with a suspension of 100 g of the coal of Example I in 600 ml of anhydrous methanol to form a reaction mixture. After continuous stirring is initiated 61.1 g of iron pentacarbonyl is added to the reaction mixture, and the mixture is heated to a temperature of about 65° C. and refluxed for a period of four hours. The mixture is then cooled, filtered, and the treated coal washed with 75% methanol/25% water. The washed coal is then reslurried in 800 ml of a 75% methanol/25% water solution. The coal slurry is passed through a high gradient magnetic separator fitted with an expanded metal matrix. The final nonmagnetic product is collected, filtered and dried. A sulfur analysis of the final nonmagnetic coal, and feed to magnetic separation as compared with the raw coal is shown in Table III:

TABLE III

| | Sulfur Content (Dry Basis-Weight %) | | |
|---|---|---|---|
| | Raw Coal | Feed to Magnetic Separation | Nonmagnetic Clean Coal |
| Pyritic Sulfur | 0.73 | — | 0.38 |
| Sulfate Sulfur | 0.53 | — | 0.01 |
| Organic Sulfur | 1.03 | — | 0.080 |
| Total Sulfur | 2.29 | 1.31 | 1.19 |

A comparison of the results shown in Tables I, II, and III demonstrates that treatment of the coal under alkaline condition of Examples III and IV results in a substantially higher reduction in pyritic, sulfate, organic and total sulfur than under the reaction conditions of Example I. It appears that treatment under the conditions of Example III results in an apparent increase in sulfate sulfur content of the treated coal, indicating a partial conversion of organic and/or pyritic sulfur to sulfate sulfur. It further appears that treatment under the conditions of Example IV results in a substantially higher reduction of pyritic, sulfate and total sulfur then under conditions of Examples I and III. Once the carbonaceous material has been treated to alkaline solution of iron pentacarbonyl and water, the total sulfur content of the carbonaceous material is further decreased by conventional means.

The invention has heretofore been described in connection with various presently preferred, illustrative embodiments. Various modifications may be apparent from this description. Any such modifications are intended to be within the scope of the appended claims, except insofar as precluded by the prior art.

What is claimed is:

1. A method of reducing the sulfur content of coal, comprising:

contacting the coal with a sulfur content reducing agent selected from the group consisting of metal carbonyls, other low valent metal complexes of the transition metals, derivatives thereof and mixtures thereof, and water to form a reaction mixture, maintaining the pH of the reaction mixture greater than about 7.5, and heating the reaction mixture to a temperature within the range of about 30° C. to below the decomposition temperature of the sulfur content reducing agent for a sufficient period of time to obtain a reduction in the sulfur content of the coal.

2. The method of claim 1 wherein the sulfur content reducing agent is a metal carbonyl selected from the group consisting of vanadium carbonyl, chromium carbonyl, manganese carbonyl, iron carbonyl, cobalt carbonyl, nickel carbonyl, molybdenum carbonyl, ruthenium carbonyl, palladium carbonyl, tungsten carbonyl, derivatives thereof, and mixtures thereof.

3. The method of claim 2 wherein the metal carbonyl is an iron carbonyl selected from the group consisting of iron pentacarbonyl, diiron nonacarbonyl, triiron dodecacarbonyl derivatives thereof, and mixtures thereof.

4. The method of claim 1 wherein the sulfur content reducing agent is a low valent metal complex selected from the group consisting of the metallocenes and derivatives thereof.

5. The method of claim 4 wherein the metallocene is selected from the group consisting of ferrocene and its derivatives.

6. The method of claim 1 wherein the reaction mixture is heated for at least about 30 minutes.

7. The method of claim 6 wherein the reaction mixture is heated for a period of about 1 to about 20 hours.

8. The method of claim 1 wherein the reaction mixture is heated to a temperature of about 40° C. to about 140° C.

9. The method of claim 1 wherein the reaction mixture is maintained with the range of about 7.5 to about 10.7.

10. The method of claim 9 wherein the pH of the reaction mixture is maintained by adding to the reaction mixture a base selected from the group consisting of the hydroxides, carbonates, bicarbonates and mixtures thereof of the alkali metals and the alkaline earth metals.

11. The method of claim 10 wherein the base is sodium hydroxide.

12. The method of claim 10 wherein the base is potassium hydroxide.

13. The method of claim 10 wherein the base is calcium hydroxide.

14. The method of claim 10 wherein the base is sodium carbonate.

15. The method of claim 10 wherein the base is sodium bicarbonate.

16. The method of claim 10 wherein the base is potassium carbonate.

17. The method of claim 10 wherein the base is potassium bicarbonate.

18. The method of claim 10 wherein the base is calcium carbonate.

19. The method of claim 1 which further comprises adding a solvent to the reaction mixture prior to heating the reaction mixture.

20. The method of claim 19 wherein the solvent is an alkyl alcohol having from one to about six carbon atoms.

21. The method of claim 19 wherein the solvent is methanol.

22. The method of claim 19 which further comprises separating the carbonaceous material from the reaction mixture.

23. The method of claim 22 which further comprises washing the separated carbonaceous material.

24. The method of claim 23 wherein the carbonaceous material is washed with the solvent.

25. The method of claim 22 which further comprises treating subjecting the separated carbonaceous material to a high gradient magnetic field to separate magnetically susceptible materials from the carbonaceous material.

26. The method of claim 1 wherein the reaction mixture is heated for a sufficient period of time to reduce the organic sulfur content of the carbonaceous material.

27. The method of claim 1 wherein the reaction mixture is heated for a sufficient period of time to reduce the pyritic sulfur content of the carbonaceous material.

28. The method of claim 24 wherein the carbonaceous material is washed with a sufficient amount of the solvent to reduce the sulfate sulfur content of the carbonaceous material.

* * * * *